US006880298B2

(12) United States Patent
Davies

(10) Patent No.: US 6,880,298 B2
(45) Date of Patent: Apr. 19, 2005

(54) BUILDING STRUCTURE

(75) Inventor: Brian Davies, Esperance (AU)

(73) Assignee: Brian Investment Pty. Ltd., Esperance (AU)

( * ) Notice: Subject to any disclaimer, the term of this patent is extended or adjusted under 35 U.S.C. 154(b) by 76 days.

(21) Appl. No.: 10/409,448

(22) Filed: Apr. 9, 2003

(65) Prior Publication Data

US 2003/0167702 A1 Sep. 11, 2003

Related U.S. Application Data

(63) Continuation-in-part of application No. 09/637,931, filed on Aug. 14, 2000, now Pat. No. 6,588,157.

(30) Foreign Application Priority Data

Jun. 26, 2000 (AU) ..... 42684/00

(51) Int. Cl.[7] ..... E04B 7/00

(52) U.S. Cl. ..... 52/81.1; 52/81.4; 52/80.1; 446/112; 446/115

(58) Field of Search ..... 52/81.1, 81.4, 52/80.1, 80.2, 81.3, DIG. 10; 446/112, 115

(56) References Cited

U.S. PATENT DOCUMENTS

| | | | |
|---|---|---|---|
| 2,944,370 | A | 7/1960 | Malarkey |
| 3,646,718 | A | 3/1972 | McKenna |
| 3,881,284 | A | 5/1975 | Martin |
| 3,921,555 | A | 11/1975 | Suzuki et al. |
| 4,180,950 | A | 1/1980 | Foster |
| 4,285,174 | A | 8/1981 | Knight |
| 4,287,690 | A | 9/1981 | Berger et al. |
| 4,306,392 | A | 12/1981 | SoRelle |
| 4,680,901 | A | 7/1987 | Armitage |
| 4,686,801 | A | 8/1987 | Eriksson et al. |
| 5,170,599 | A | 12/1992 | Knight |
| 5,394,661 | A | 3/1995 | Noble |
| 5,452,555 | A | 9/1995 | Lee |
| 5,505,025 | A | 4/1996 | Fleishman |
| 5,628,154 | A | 5/1997 | Gavette |
| 5,732,518 | A | 3/1998 | Roberts |
| 6,134,849 | A | 10/2000 | Holler |
| 6,216,410 | B1 | 4/2001 | Haberman |
| 6,295,785 | B1 | 10/2001 | Herrmann |

FOREIGN PATENT DOCUMENTS

| | | |
|---|---|---|
| AU | 65811/69 | 7/1971 |
| AU | 3966/72 | 9/1973 |
| AU | 53797/90 | 10/1990 |
| AU | 2000027615 | 10/2000 |
| FR | 2307217 | 5/1976 |
| JP | 406093688 A | 4/1994 |
| WO | WO 02/01024 | 1/2002 |

*Primary Examiner*—Naoko Slack
*Assistant Examiner*—Jennifer I. Thissell
(74) *Attorney, Agent, or Firm*—Edell, Shapiro & Finnan, LLC

(57) ABSTRACT

A building structure (10 or 10') has a wall (16) including a plurality of wall elements (12 or 12'). Each wall element is connected to a plurality of other wall elements so as to form the wall. Each wall element includes a connecting means for connecting the adjacent wall elements together to form the wall. The wall is formed at least three consecutively connected rings (15 or 15 and 17) of interlocking wall elements. Each of the wall elements in each ring being of the same size. Each of the wall elements in a first ring of the consecutively connecting rings being larger than the wall elements of a second ring of the consecutively connected rings and each of the elements in the second ring being larger than the wall elements of a third ring of the consecutively connected rings.

28 Claims, 7 Drawing Sheets

BUILDING STRUCTURE

The present application is a continuation-in-part of U.S. Ser. No. 09/637,931 filed Aug. 14, 2000, now U.S. Pat. No. 6,588,157.

The present invention relates to a building structure and a method of forming a building structure. In particular, although not exclusively, the present invention relates to a storage structure.

Typically, buildings are constructed with walls of bricks and/or other building material. A roof is then built on top of the wall. The roof is made of different building materials again. Having many types of building material presents difficulties due to the variety of construction techniques that must be employed and the associated expense. Where the building is to be air-tight, all the joins must be sealed.

When the building is used for grain storage, the shape of the structure needs to account for the manner in which grain lies on the ground. Due to the particulate nature of grain, it prefers a structure having a round base and, depending on the type of grain, a rill angle of about 30°. Dome shaped structures are ideal for storing grain as they have an internal shape to accommodate the grain, as well as an external shape which provides a wind resistant profile. Unfortunately dome shaped structures are difficult to build using traditional building materials and construction techniques.

Prior art dome shaped structures are comprised of building elements which are either not hexagonal in shape or rely on a combination of hexagons and other shapes to accommodate the curve in the dome shaped wall.

An object of the present invention is to overcome at least some of the above problems by providing a building structure that can be more easily constructed, and is suited to dome shaped structures.

In accordance with a first aspect of the present invention, there is provided a building structure comprising a wall including a plurality of wall elements, each wall element having a hexagonal shape and connecting to a plurality of other wall elements so as to form the wall, wherein each wall element includes a connecting means for connecting the adjacent wall elements together to form the wall, first and second sides of the same length, third and fourth adjacent sides, located opposite said first and second sides respective, of the same length, and fifth and sixth opposite sides, located between said first and fourth sides and between said second and third sides respectively, of the same length, wherein said first and second sides are longer than said fifth and sixth sides, and said fifth and sixth sides are in turn longer than said third and fourth sides, whereby, in use, the wall elements can be tessellated to form a dome-shaped structure.

In accordance with a second aspect of the present invention there is provided a building structure having a wall including a plurality of tessellated hexagonal wall elements, each wall element connected to a plurality of other wall elements so as to form the wall.

Preferably, the wall is formed of at least three consecutively connected rings of interlocking wall elements, each of the wall elements in each ring being of the same size, each of the wall elements in a first ring of the consecutively connected rings being larger than the wall elements of a second ring of the consecutively connected tings and each of the elements in the second ring being larger than the wall element to a third ring of the consecutively connected rings.

Preferably, each wall element in each subsequent ring of the consecutively connected rings are smaller than the wall elements of the preceding ring.

Preferably, each wall element includes first and second sides of the same length, third and fourth adjacent sides, located opposite said first and second sides respectively, are of the same length, and fifth and sixth sides, located between said first and fourth sides and between said second and third sides respectively, and wherein said first and second sides are longer than said third and fourth sides.

Preferably, the fifth and sixth sides are of the same length, the fifth and sixth sides being longer than the firs and second sides and shorter than the third and fourth sides.

Preferably, the fifth side is shorter than the first and second sides and the sixth side is longer than the third and fourth sides.

Preferably, the connecting means of each wall element includes an interlocking portion located on each side of the wall element for connecting each said side to another side of another wall element.

Preferably, the interlocking portions connecting two wall elements together include a complementary projection and recess, one of each formed on each respective connecting sides.

Preferably, each wall element includes a first face and a second face opposite the first face, the first face of each wall element is of concave shape. Preferably, the first face of each wall element, in use, collectively forms an interior face of the wall.

Preferably, the second face of each wall element is convex in shape. Preferably, the second face of each wall element, in use, collectively forms an exterior face of the wall.

Preferably, the length of a shortest side of a building element in the largest diameter ring is equal to the length of a longest side of a building element in the next largest diameter (next consecutive) ring.

Also in accordance with the present invention there is provided a method of constructing a building structure including the steps of: constructing a dome-shaped wall made of hexagonal wall elements by placing each wall element adjacent to another wall element so as to tessellate the wall elements to form the wall.

Preferably, the dome-shaped wall is constructed by the steps of forming a first ring of first sized wall elements forming a second ring of second sized wall elements, wherein the second sized wall elements are smaller than the first sized wall elements, such that the second ring tessellates with the first ring forming a third ring of third sized wall elements, wherein the third sized wall elements are smaller than the second sized wall elements such that the third ring tessellates with the first ring.

Preferably, each wall element includes first and second sides of the same length, third and fourth adjacent sides, located opposite said first and second sides respectively, of the same length, and fifth and sixth sides, located between said first and fourth sides and between said second and third sides respectively, and wherein said first and second sides are longer than said third and fourth sides.

Preferably, adjacent wall elements are connected by placing them with the sides of each of the adjacent wall elements abutting, and connecting an interlocking portion located on each side of the adjacent wall elements.

Preferably, an inside face of each wall element forms a part of an inside surface of the wall. Preferably, an outside face of each wall element forms a part of an outside surface of the wall. Preferably, a curve in the body of each wall element contributes to the some-shape of the wall. Preferably, a concave curve of the inside face of each wall element contributes to form a constant concave curve in the inside of the wall. Preferably, the wall elements are placed so that a convex curve of the outside face of each wall element contributes to form a constant curve in the outside surface of the wall.

Also in accordance with the present invention there is provided a wall element for use in constructing a wall of a dome-shaped building structure, said wall element including a connecting means for connecting the wall element to other wall elements to form the wall, and wherein said wall element is of hexagonal shape, wherein first and second sides are of the same length, and third and fourth adjacent sides, located opposite said first and second sides respectively, are of the same length, and wherein said first and second sides are longer than said third and fourth sides, whereby, in use, a plurality of said wall elements can be tessellated to form a dome-shaped structure.

Also in accordance with the present invention there is provided a building structure including a wall including a plurality of wall elements, each wall element connected to a plurality of other wall elements so as to form the wall, wherein each wall element includes a connecting means for connecting the adjacent wall elements together to form the wall, wherein the wall element is hexagonal in shape with three of the sides of each wall element having a tongue thereon and three of the sides of the wall element having a groove therein, such that the tongues and grooves of the wall elements are arranged to form the connecting means between adjacent wall elements, whereby, in use, the wall elements can be tessellated to form a dome-shaped structure.

Preferably, each wall element is in the form of a tile.

Preferably, the interlocking portions that connect two wall elements together are a complementary projection and recess, one of each formed on each of the sides connected together. Preferably, three of the sides of the hexagon have the projection and the other three sides have the recess.

Preferably, all wall elements of each ring are uniform in size and shape.

In accordance with the present invention, there is provided a method of constructing a building structure having a curved wall including the steps of:

connecting a plurality of wall elements having a first size together to form a first ring, connecting a plurality of wall elements having a second size, smaller than the first size, together to form a second ring interlocking with the first ring, connecting a plurality of wall elements having a third size, smaller than the second size, together to form a third ring, interlocking with the second ring, wherein each wall element having a connection means for connecting each wall element to a corresponding connection means of each adjacent wall element, whereby the interlocking rings of the wall elements form the curved wall.

In order to provide a better understanding of the present invention, an embodiment will now be described with reference to the accompanying drawings, in which.

Figure 1:
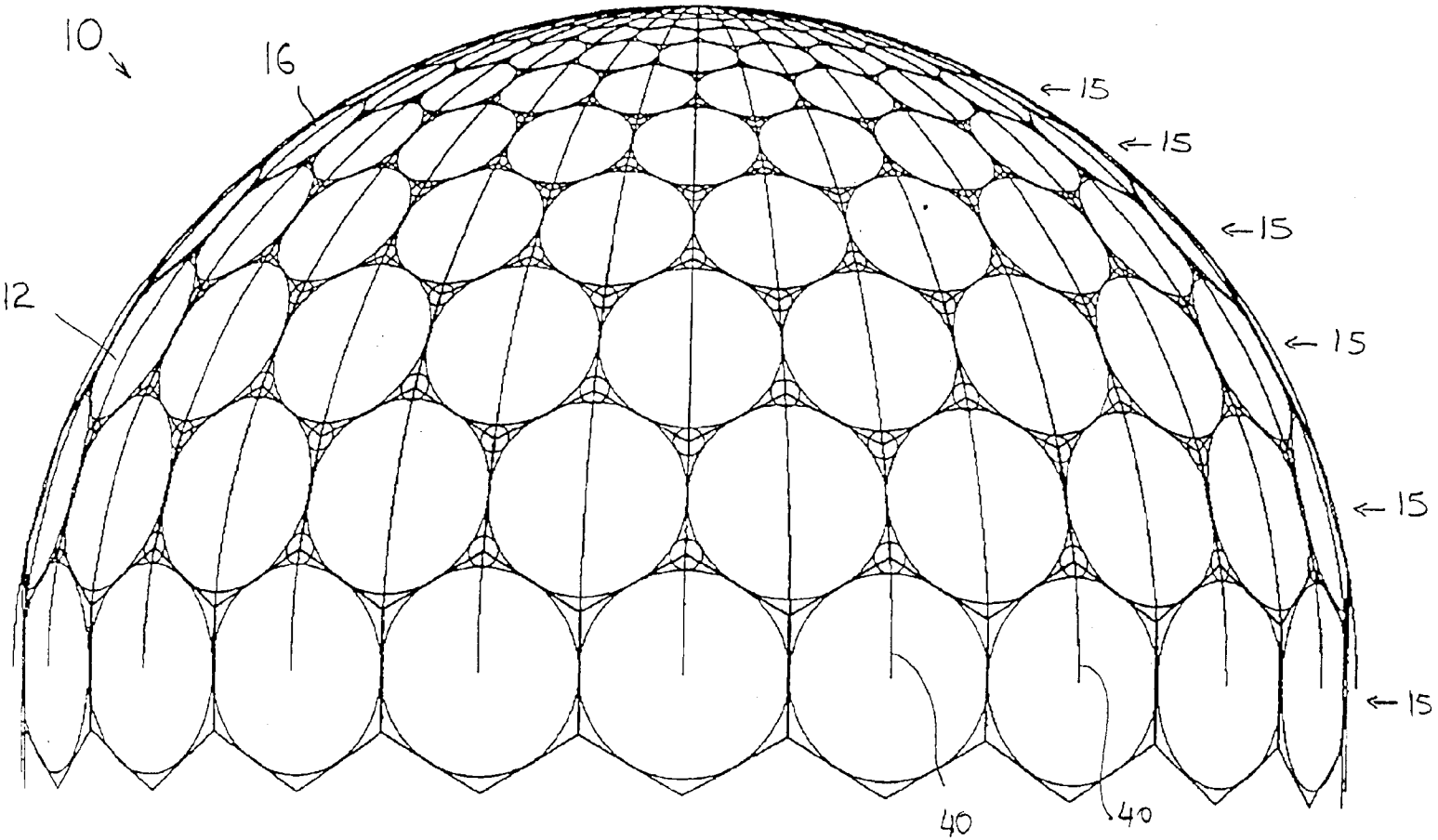
FIG. 1 is a side view of a schematic representation of an embodiment of a building being constructed in accordance with the present invention.

Referring to FIG. 1, there is shown a first embodiment of a building structure 10, which includes a wall 16 comprising a plurality of wall elements 12. The wall elements are connected together to form the wall 16. The wall elements 12 are arranged in rings 15. The wall elements 12 in each ring 15 are of the same size and shape. The rings 15 are of decreasing radius (size) and sit one on top of the other in an interlocking manner. The wall elements 12 of each consecutive ring are smaller than the wall elements of the previous ring.

Figure 2:
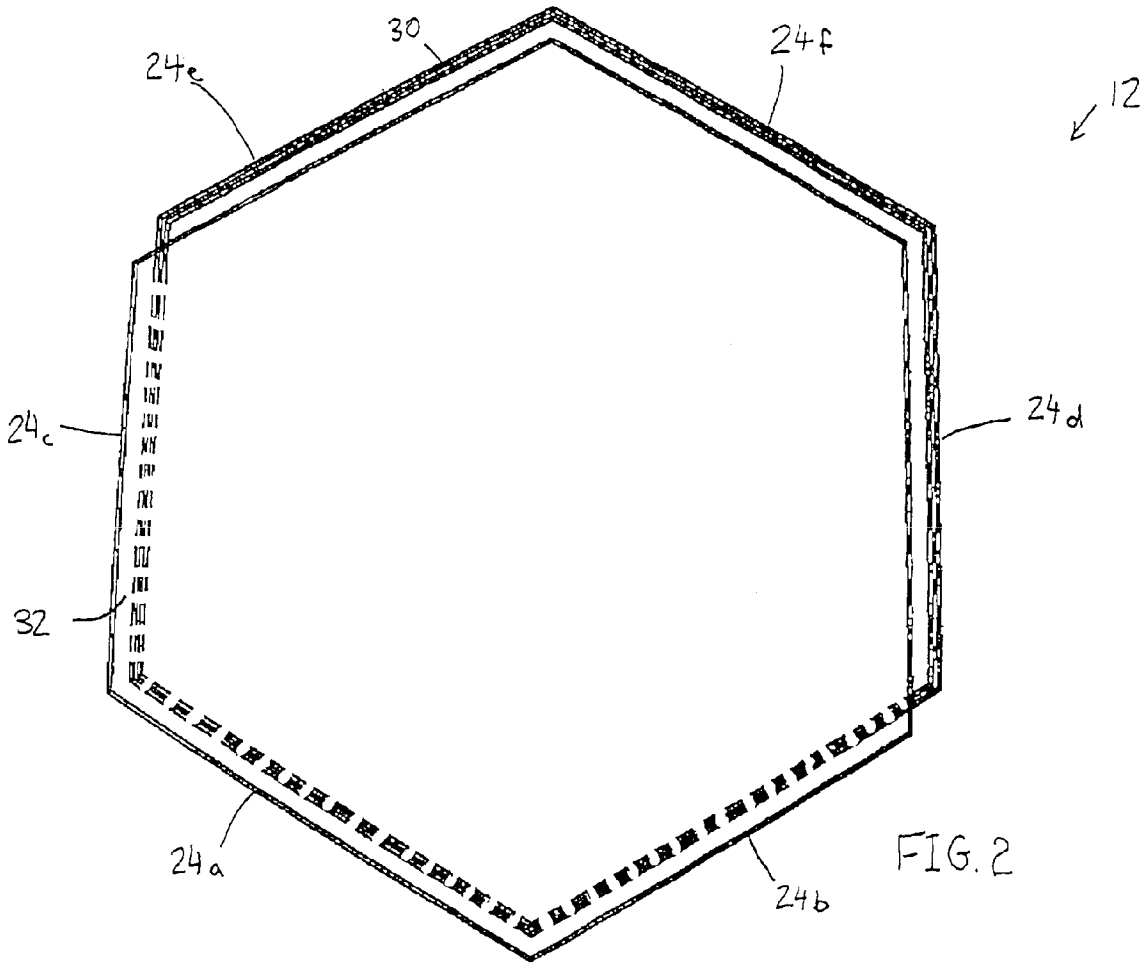
FIG. 2 is a plan view of a wall element used to construct a building in accordance with the present invention.
Figure 3:
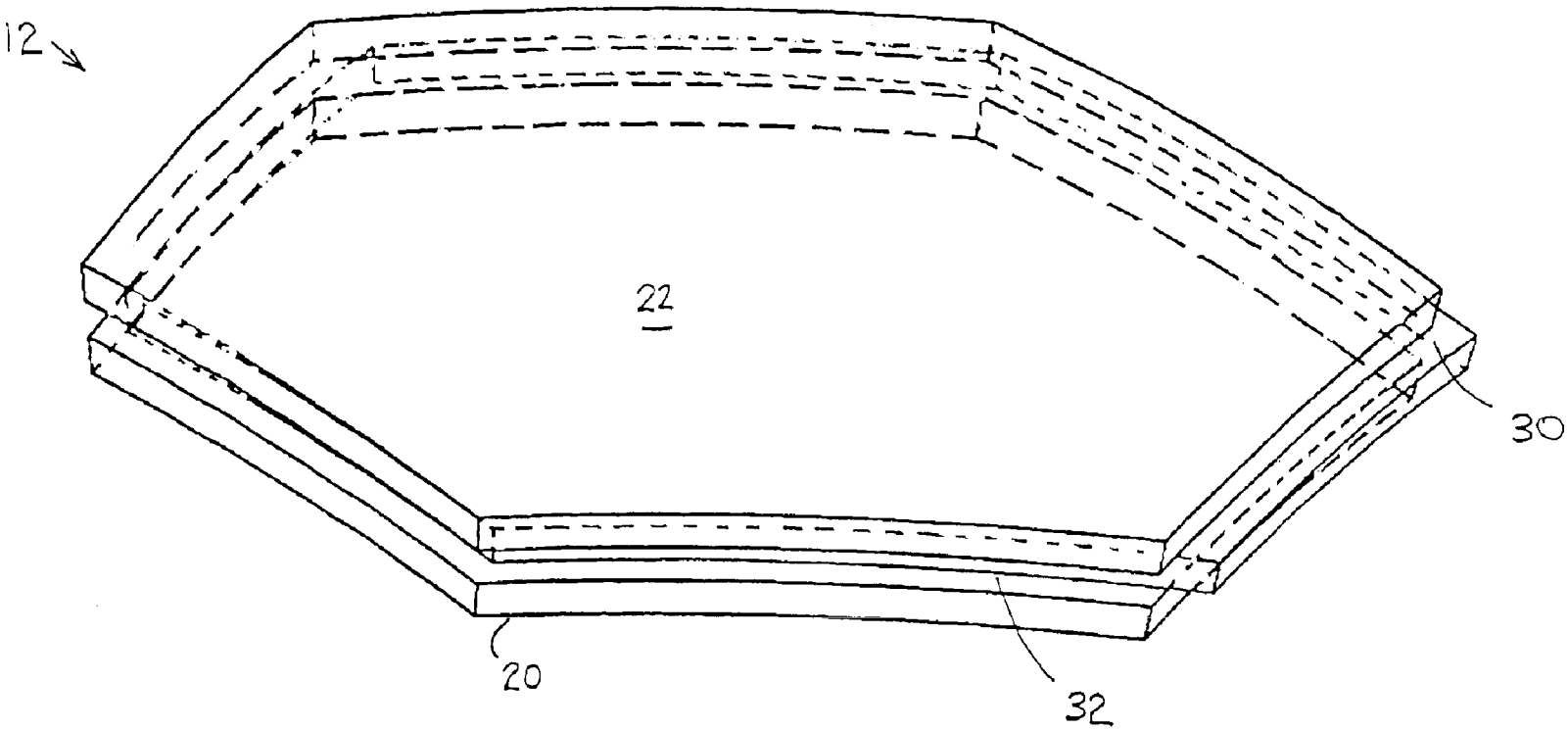
FIG. 3 is a perspective view of the wall element of FIG. 2.
Figure 4:
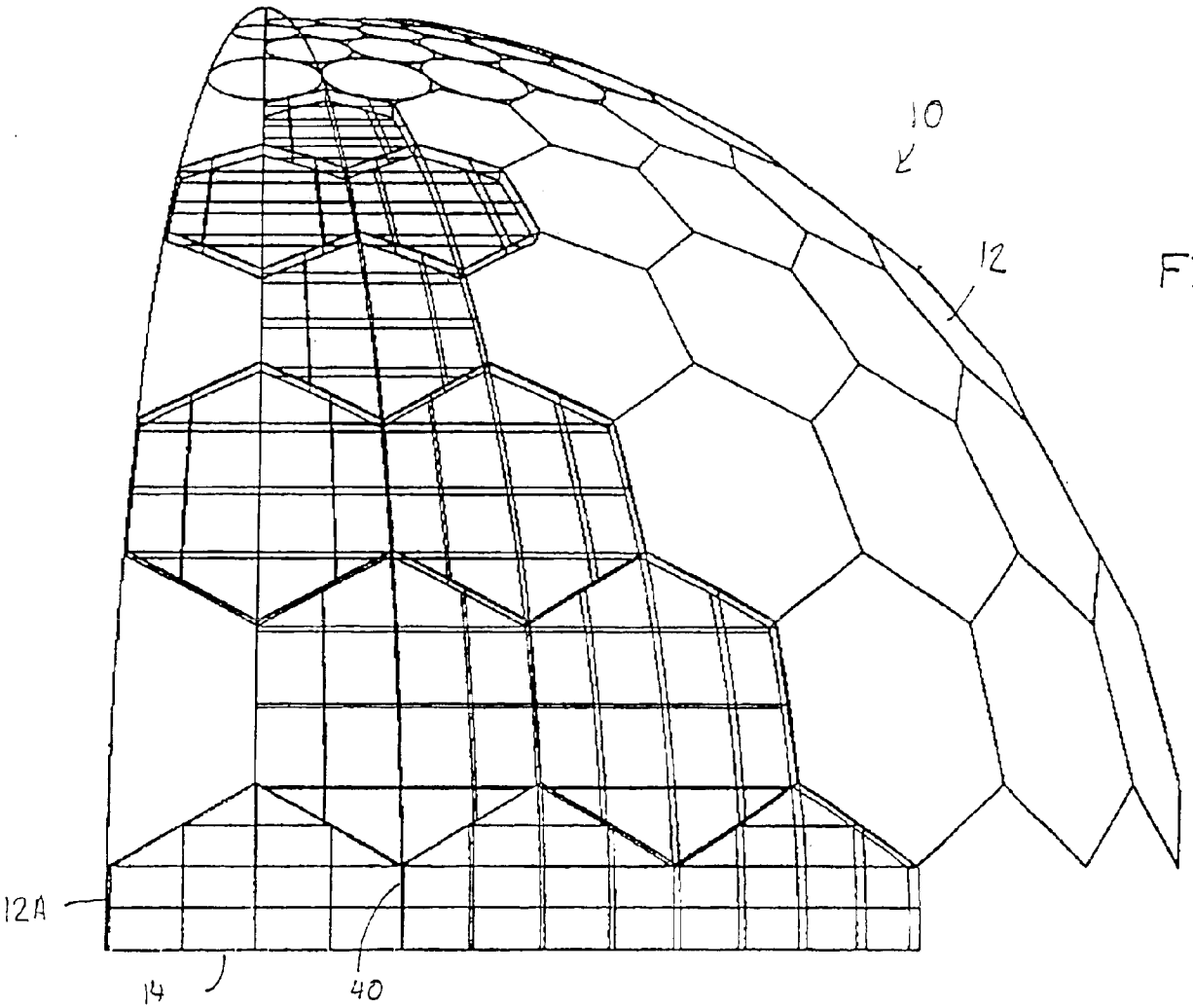
FIG. 4 is a perspective view of a section of a wall of the building of FIG. 1.

Referring to FIGS. 2 and 3, each wall element 12 in the form of a tile. The wall element 12 includes an inside face 20 and an opposed outside face 22. The wall element 12 also includes a plurality of sides 24. The wall element is roughly hexagonal in plan view, therefore there are six sides 24. The wall elements 12 are not true hexagons though as the length of the sides are not the same size. Sides 24*a* and 24*b* are the same length, 24*c* and 24*d* are the same length and 24*e* and 24*f* are the same length. However sides 24*a* and 24*b* are longer than sides 24*c* and 24*d*, which are longer than sides 24*e* and 24*f*. It can also be seen that opposite sides (for example 24*c* and 24*d*) are not parallel.

The body of the wall element 12 is curved. More specifically, the wall element 12 is shaped with a concave curve on the inside face 20. The wall element is also shaped with a convex curve on the outside face 22. The curvature of the body, and the inside and outside faces is such that when the wall elements 12 are coupled together to form the wall 16 the wall is curved so as to form a hollow hemisphere. That is, the radius of curvature of the inside face 20 is the inside radius of the hemisphere and the radius of the curvature of the outside face 22 is the outside radius of the hemisphere.

Each wall element 12 is connected to another wall element by abutting sides of adjacent wall elements and interlocking a complementary projection 30 and recess 32 between the adjacent wall elements. One side of one of the abutted wall elements has the projection 30 and the other has the recess 32. In this case, three of the sides 24 have the projection 30 and three of the sides 24 have the recess 32. There are three projections 30 on three adjacent sides and three recesses 32 on the other three adjacent sides. In this embodiment each projection 30 is in the form of a tongue and each recess 32 is in the form of a groove adapted to receive the tongue in close-fitting relation.

Figure 6:
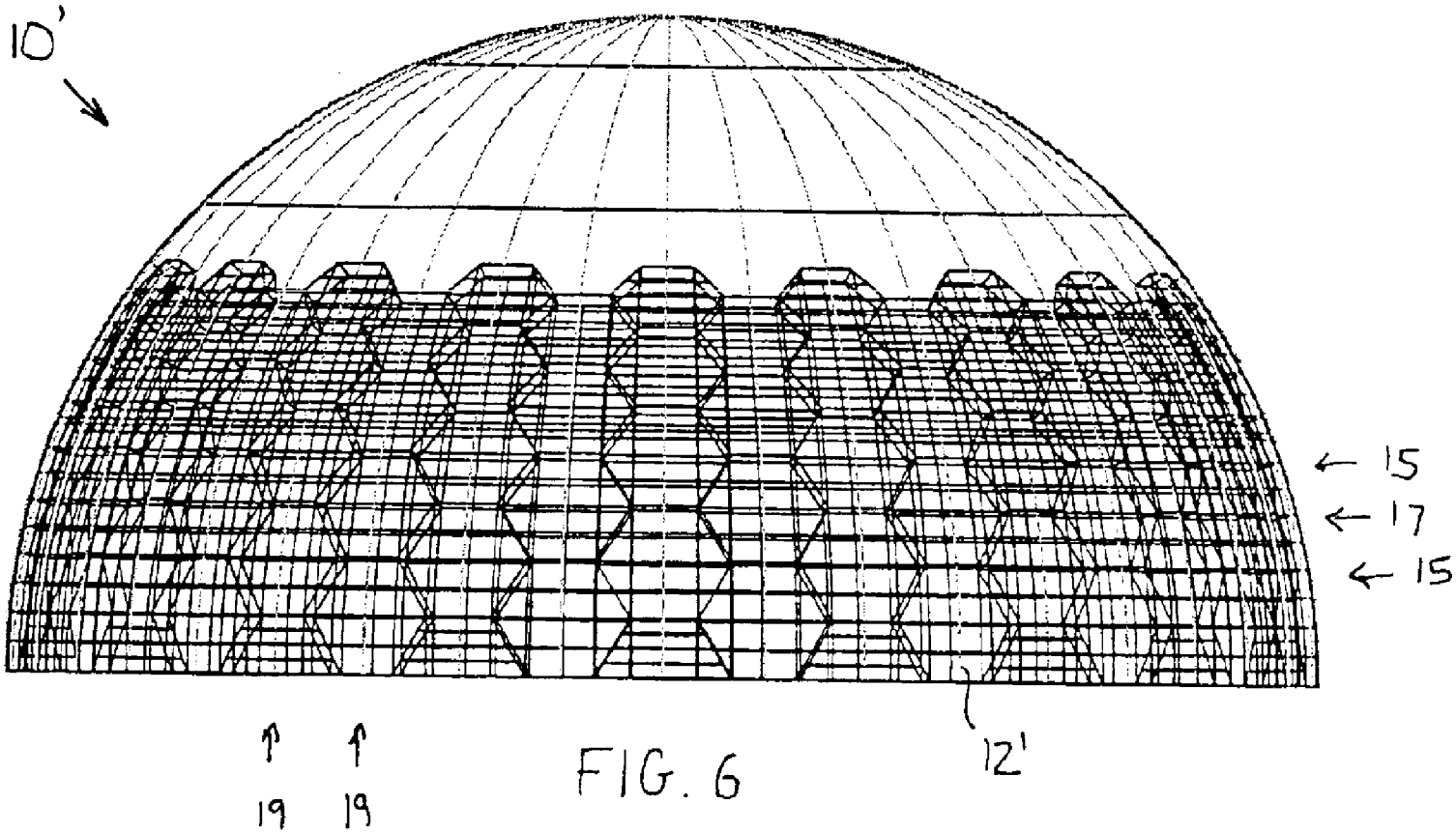
FIG. 6 is a side view of schematic representation of an alternative embodiment of a building structure in accordance with the present invention.

Referring to FIG. 6, there is shown an alternative building structure 10'. This building structure is constructed in a similar manner to the building structure 10 of the previous embodiment, with the exception that each of the wall elements 12' are rotated by 30°. In other words, a pair of opposite parallel sides of the wall elements 12' are horizontal rather than opposite sides being in line with vertical arcs over the surface of the building structure as shown in FIG. 1.

In this embodiment vertical rings 19 of wall elements extend in a vertical direction. Rings 15 in this embodiment are interlaced with rings 17. Wall elements 12' in ring 17 are positionally 180° out of phase with wall elements 12' in rings 15. Each of the wall elements are progressively smaller in size moving up the surface of the building structure 10'.

Figure 7:
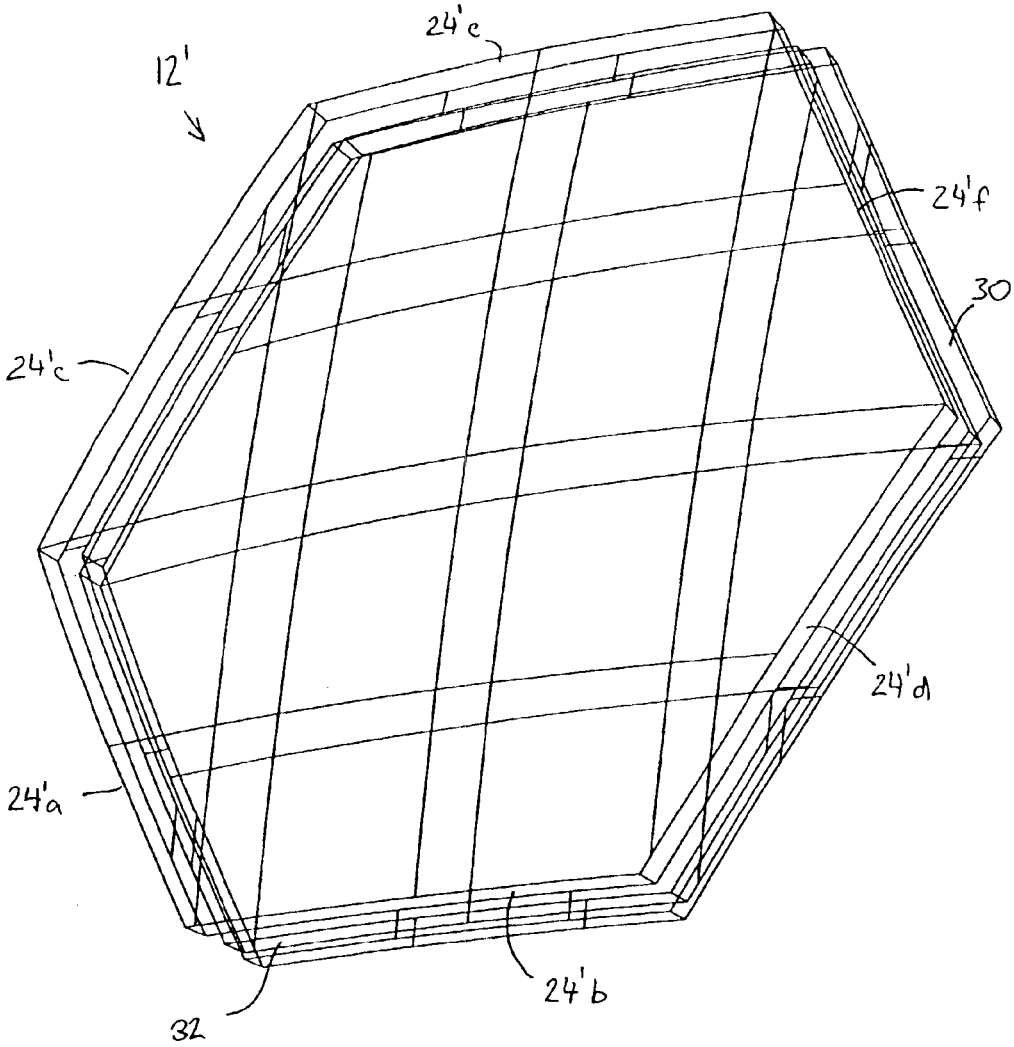
FIG. 7 is a perspective view of a wall element of the building of FIG. 6.

Referring to FIG. 7 in order to arrange the wall elements 12' to achieve the dome shape shown in FIG. 6, each wall element 12' is of a slightly different shape to the shape of the wall element 12 of the previous embodiment. Here, sides 24*e'* and 24*b'* are parallel. Side 24*b'* is the longest side of all and 24*e*' is the shortest side of all. 24*a*' and 24*d*' are of the same length, 24*c*' and 24*f*' are of the same length, but shorter than 24*a*' and 24*d*'.

It can be seen that the dimensions of the tiles can be calculated from the arcs drawn over the surface of the building structures 10 and 10'. Furthermore, the length of the shorter side in any wall element in one ring is equal to the length of the longest side of the wall element in the subsequent ring. In the structure 10', there is only one longest side and one shortest side for element. In the structure 10, there are two longest sides and two shortest sides.

The wall elements may be constructed of high density foam, aerated concrete, plastic epoxy resin, foamed plastic or any other suitable building material. The wall elements may even be injection molded on site to reduce transport costs.

An adhesive may be used between the projections and recess of each wall member to permanently connect the wall elements together. The adhesive may also act as a sealant so that the join between each wall member is airtight.

The interconnection between each wall element may be reinforced by using pins secured through each projection and recess when they interlock together. The pins increased tensile strength across the interlock and provide improved internal loading. Internal reinforcing may be required within each wall element to withstand load stress of the pins on the wall element.

The building structure 10 or 10' may be constructed by positioning wall elements in their correct position in each ring 15 (and 17). There may be, for example, 20 wall elements in each ring. It is preferred that the number of wall elements evenly divide into 360°. Layers of wall elements may be formed by placing wall elements in concentric rings. Each ring is formed one on top of the other. In particular, layers of rings of the same size of wall elements are used. When the layer is completed the next is commenced, with smaller wall elements needed to create the next layer in another ring of smaller radius. Each ring will have the same numbers of elements as the previous ring. Typically there are about 10 rings.

The process is repeated until a single top element can be positioned in the remaining hole. The top element will have a number of sides equal to twice the number in each ring.

The first layer of wall elements placed on the foundation 14 may alternate between half elements 12A and complete wall elements 12. This allows the base edge of the wall to be flat and secured on the foundation.

Each wall element in the first ring may be, for example 2 to 3 meters in height. The actual size of the wall elements will vary depending on the desired radius and size of the building structure to be constructed.

Figure 5:
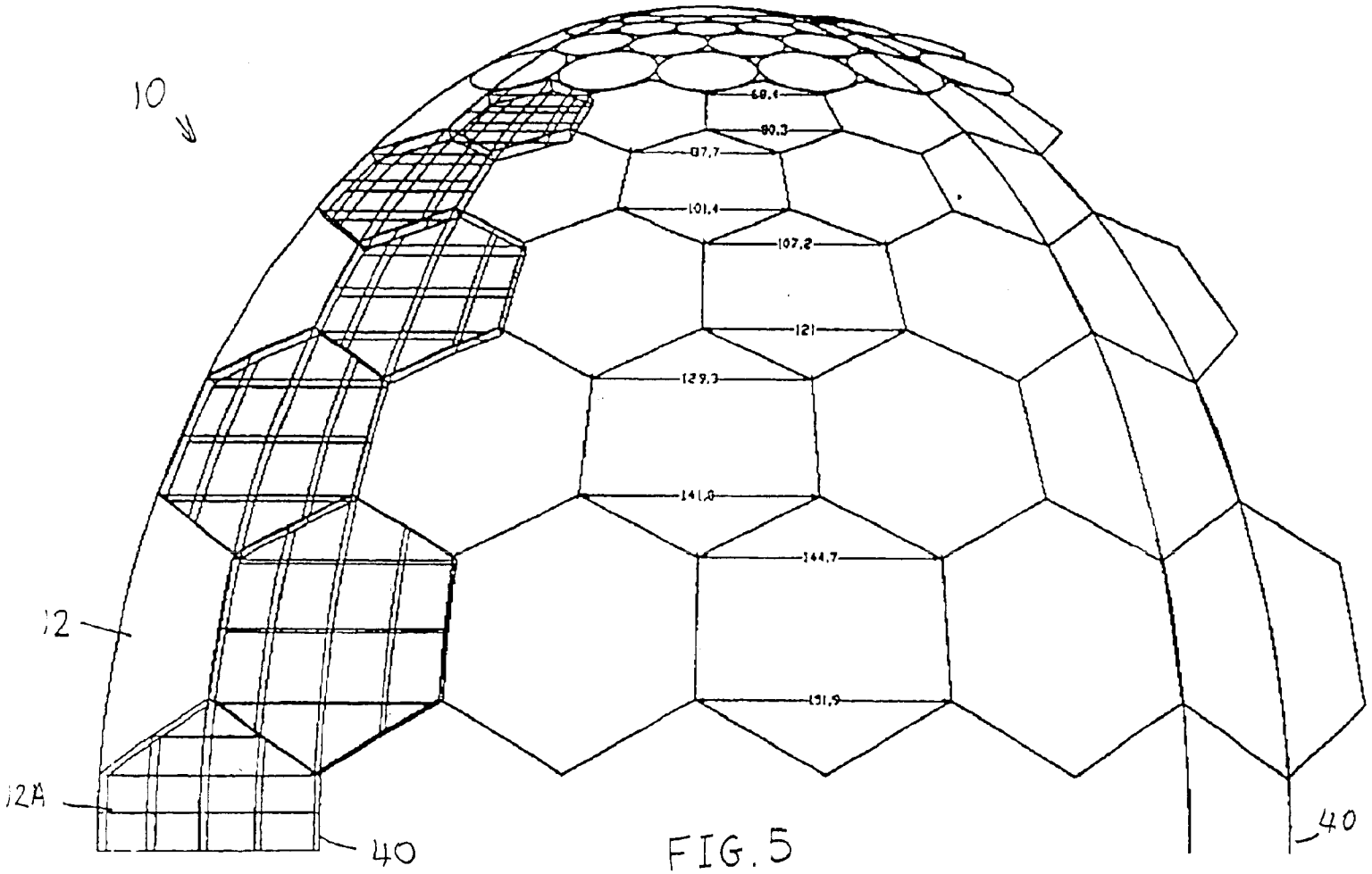
FIG. 5 is a perspective view of an example of a section of a wall showing the irregular nature of the wall elements in each ring of wall elements.

Because of the curve (shown as lines 40) the included angle between each side of the wall elements is not 60° as in the case in an ordinary hexagon. This problem is solved by reducing the size of the tile in each ring (as described above) and by adjusting the shape of the tile. FIGS. 2 and 5 show the tile narrowing towards the top just as the lines 40 narrow closer to the top of the structure as you go. Example measurements are shown in FIG. 5 which represent the relative size relationship between tiles of each ring.

It will be clear to those skilled in the art that the present invention has at least the following advantages:

(i) the building structure may be of a dome shape which is well suited to storing, for example, grain and is also well suited to resist wind loading;

(ii) the building structure may be constructed relatively quickly and easily and will thus provide cost efficiencies.

Modifications and variations can be made to the present invention without departing from the basic inventive concepts, such as the projections and recesses of each wall element may alternate from one side to the next side rather than three projections in a row and three recess in a row.

All such modifications are intended to be considered within the scope of the present invention the nature of which is to be determined from the foregoing description and appended claims.

What is claimed is:

1. A building structure having a wall including a plurality of tessellated hexagonal wall elements, each wall element connected to a plurality of other wall elements so as to form the wall, wherein the wall is formed of at least three consecutively connected rings of interlocking wall elements, each of the wall elements in each ring being of the same size, each of the wall elements in a first ring of the consecutively connected rings being larger than the wall elements of a second ring of the consecutively connected rings and each of the elements in the second ring being larger than the wall elements of a third ring of the consecutively connected rings.

2. A building structure according to claim 1, wherein each wall element in each subsequent ring of the consecutively connected rings are smaller than the wall elements of the preceding ring.

3. A building structure according to claim 1, wherein each wall element includes first and second sides of the same length, third and fourth adjacent sides, located opposite said first and second sides respectively, are of the same length, and fifth and sixth, located between said first and fourth sides and between said second and third sides respectively, are wherein said first and second sides are longer than said third and fourth sides.

4. A building structure according to claim 3, wherein the fifth and sixth sides are of the same length, the fifth and sixth sides being longer than the first and second sides and shorter than the third and fourth sides.

5. A building structure according to claim 3, wherein the fifth side is shorter than the first and second sides and the sixth side is longer than the third and fourth side.

6. A building structure according to claim 1, wherein the length of a shortest side of a building element in the largest diameter ring is equal to the length of a longest side of a building element in the next largest diameter (next consecutive) ring.

7. A building structure according to claim 1, wherein the connecting means of each wall element includes an interlocking portion located on each side of the wall element for connecting each said side to another side of another wall element.

8. A building structure according to claim 7, wherein the interlocking portions connecting two wall elements together include a complementary projection and recess, one of each formed on each respective connecting sides.

9. A building structure according to claim 1, wherein each wall element includes a first face and second face opposite the first face, the first face of each wall element is of concave shape and the second face of each wall element is convex in shape.

10. A building structure according to claim 9, wherein the first face of each wall element, in use, collectively forms an interior face of the wall and the second face of each wall element, in use, collectively forms an exterior face of the wall.

11. A building structure comprising a wall including a plurality of wall elements, each wall element having a hexagonal shape and connecting to a plurality of other wall elements so as to form the wall, wherein each wall element includes a connecting means for connecting adjacent wall elements together to form the wall, first and second adjacent sides, third and fourth opposing sides, and fifth and sixth adjacent sides, the first and fourth sides being of the same length and longer than the second side, the third and sixth sides being of the same length and shorter than each of the first and fourth sides, the fifth side being longer than the third and sixth sides, and wherein the wall elements are tessellated to form a dome-shaped structure.

12. A building structure according to claim 11, wherein the second and fifth sides of each wall element are parallel.

13. A building structure according to claim 11, wherein the connecting means of each wall elements includes an interlocking portion located on each side of the respective wall element for connecting each side of the respective wall element to a corresponding side of another wall element.

14. A building structure according to claim 11, wherein each wall element includes a first face and a second face opposite the first face, the first face of each wall element is of concave shape, wherein the first face of each wall element, in use, collectively forms an interior face of the wall.

15. A building structure according to claim 11, wherein the second face of each wall element is convex in shape, the second face of each wall element, in use, collectively forms an exterior face of the wall.

16. A building structure according to claim 13, wherein the interlocking portions connection two wall elements together include a complementary projection and a recess, and the projection is formed on a connecting side of one of the two wall elements while the recess is formed on a corresponding connecting side of the other of the two wall elements.

17. A building structure according to claim 11, wherein the wall is formed by at least three consecutively connected rings of interlocking wall elements, each of the wall elements in each ring being of the same size, each of the wall elements in a first ring of the consecutively connected rings being larger than the wall elements of a second ring of the consecutively connected rings and each of the wall elements in the second ring being larger than the wall elements of a third ring of the consecutively connected rings.

18. A building structure according to claim 17, wherein the length of a shortest side of a building element in the largest diameter ring is equal to the length of a longest side of a building element in the next largest diameter (next consecutive) ring.

19. A method of constructing a building structure including the steps of:

constructing a dome-shaped wall made of hexagonal wall elements by placing each wall element adjacent to another wall element so as to tessellate the wall elements to form the wall, wherein the dome-shaped wall is constructed by the steps of:

forming a first ring of first sized wall elements;

forming a second ring of second sized wall elements, wherein the second sized wall element are smaller than the first sized wall elements, such that the second ring tessellates with the first ring;

and forming a third ring of third sized wall elements, wherein third sized wall elements are smaller than the second sized wall elements such that the third ring tessellates with the first ring.

20. A method of constructing a building structure including the steps of:

constructing a wall made of wall elements by placing each wall element adjacent a plurality of other wall elements and fastening a connecting means of each wall element of a corresponding connecting means of each adjacent wall element, wherein each wall element has a hexagonal shape and includes first and second adjacent sides, third and fourth opposing sides, and fifth and sixth adjacent sides, the first and fourth sides being of the same length and longer than the second side, the third and sixth sides being of the same length and shorter than each of the first and fourth sides, the fifth side being longer than the third and sixth sides; and tessellating the wall elements to form a dome-shaped structure.

21. A wall element for use in constructing a wall of a building structure, the wall element including a connecting means for connecting the wall element to other wall elements to form the wall, wherein the wall element is of a hexagonal shape and includes first and second adjacent sides, third and fourth opposing sides, and fifth and sixth adjacent sides, the first and fourth sides being of the same length and longer than the second side, the third and sixth sides being of the same length and shorter than each of the first and fourth sides, the fifth side being longer than the third and sixth sides wherein, in use, the wall element can be tessellated with a plurality of other wall elements to form a dome-shaped structure.

22. A wall element according to claim 21, wherein the second and fifth sides of the wall element are parallel.

23. A wall element according to claim 21, wherein the connecting means of the wall element includes an interlocking portion located on each side of the wall element for connecting each side of the respective wall element to a corresponding side of another wall element.

24. A wall element according to claim 23, wherein each interlocking portion includes one of a projection and a complimentary recess that interlocks with the other of the projection and complimentary recess located on the corresponding side of another wall element.

25. A wall element according to claim 21, wherein the wall element includes a first face and second face opposite the first face, the first face of the wall element being of concave shape and the second face of the wall element is convex in shape.

26. A building structure comprising a wall including a plurality of wall elements, each wall element having a hexagonal shape and connecting to a plurality of other wall elements so as to form the wall, wherein each wall element includes a connecting means for connecting adjacent wall elements together to form the wall, first and second adjacent sides, third and fourth opposite sides and fifth and sixth adjacent sides, wherein a first set of non-opposite two sides are of the same length, and a second set of two non-opposite sides are of the same length and longer than the length of each of the sides of the first set such that either (a) the wall element is symmetrical about a line between the corners between first and second sides and fifth and sixth sides and shape of the wall elements narrows towards a corner between the first and second sides or (b) the second side and the fifth sides are parallel and the wall element narrows towards the second side.

27. A building structure according to claim 26, wherein the shape of the tile narrows towards the corner between the first and second sides and a third set of two of the sides are of the same length and longer than the length of each of the sides in the first and second sets of sides.

28. A building structure according to claim 26, wherein the shape of the tile narrows towards the second side and second side is shorter than all the other sides and the fifth side is longer than all the other sides.

* * * * *